United States Patent [19]

Kupka

[11] 4,383,768

[45] May 17, 1983

[54] STIRRING APPARATUS

[76] Inventor: Dieter Kupka, Postfach 59, Binger Landstrasse 37a, 6570 Kirn, Fed. Rep. of Germany

[21] Appl. No.: 373,641

[22] Filed: Apr. 30, 1982

Related U.S. Application Data

[63] Continuation of Ser. No. 140,507, Apr. 15, 1980, abandoned.

[30] Foreign Application Priority Data

Nov. 15, 1979 [DE] Fed. Rep. of Germany ..... 2946126

[51] Int. Cl.[3] ..... B01F 15/00

[52] U.S. Cl. ..... 366/279; 277/9; 277/109; 277/111; 277/116.4; 366/349

[58] Field of Search ..... 366/241, 251, 261–265, 366/270, 279, 282, 286, 349; 277/1, 9, 109, 111, 116.4

[56] References Cited

U.S. PATENT DOCUMENTS 2,638,364 5/1953 Rechtin ..... 277/9 X
3,572,650 3/1971 Kupka ..... 366/286 X

FOREIGN PATENT DOCUMENTS 1557104 6/1970 Fed. Rep. of Germany ..... 366/349
2363237 6/1975 Fed. Rep. of Germany ..... 366/349

*Primary Examiner*—Philip R. Coe
*Attorney, Agent, or Firm*—Toren, McGeady and Stanger

[57] ABSTRACT

In a stirring apparatus for sealed mounting on a vessel, in which apparatus a distance between a mounting flange (15) and drive elements of the stirring shaft (2) is bridged by a load-bearing intermediate housing (also called a lantern) (1+7, 50), at least a portion (1) of said housing, which portion supports the drive elements, is displaceable away from the vessel and toward it again by at least one hydraulic cylinder (3) for rendering possible the easy changing of wearing sealing elements for the stirring shaft (2) by using marketable auxiliary devices which may be attached or built in in a simple manner, standard gears too, and in a simple construction of the whole apparatus.

Suitably, special guiding bolts (4) are provided for the movable portion (1) of the intermediate housing. If the latter is divided into a movable portion (1) and a portion (7) fixed to the vessel, the fixed portion (7) is used as the seal housing. If the seal is a stuffing box packing, the stirring shaft (2) bears a collar (8) below the sealing elements (5, 9, 17) and undercutting the latters; if the seal is a slide ring seal, a cage (27), which combines the wear subjected ring sealing elements into a unit (26), is mounted at a centering collar (6) of the movable portion (1) of the intermediate housing.

13 Claims, 6 Drawing Figures

STIRRING APPARATUS

This is a continuation of application Ser. No. 140,507 filed Apr. 15, 1980, and now abandoned.

BACKGROUND OF THE INVENTION

The invention relates to a stirring apparatus, intended for sealed mounting on a container filled with material to be stirred. The stirring apparatus has a mounting flange, a stirring shaft bearing a stirring tool and driven at its end (the rearward end) remote from the container, and sealing elements disposed on the side of the mounting flange remote from the container intended for sealing the stirring shaft from the container interior. The distance between the mounting flange and the drive elements of the stirring shaft is bridged by a load-bearing intermediate housing (also called a lantern or cage housing).

In stirring apparatuses disposed on stirring vessels, and where the vessels are overpressure vessels or when the material to be stirred is poisonous, for instance, and must not be allowed to escape from the vessel even in trace amounts, the sealing of the stirring shaft from the interior of the vessel plays a special role. Stuffing-box packings suffice only in very simple cases. More difficult demands have been met by using so-called slide ring seals or mechanical seals. However, in the larger stirring apparatuses these mechanical seals are heavy units which are housed, as a rule, in their own housing. If the stirring shaft has a diameter of 160 mm, for instance, an associated mechanical seal of this kind, together with its housing, weighs about 400 kilograms. Changing such seals when they had become worm out or damaged was accordingly difficult and time-consuming work, which frequently could not be performed by one person working alone. Originally, the gear had to be removed first, as a rule, and the gear drive shaft separated from the stirring shaft; then the stirring apparatus lantern housing had to be removed; next, the mechanical seal had to be lifted either by hand or by removal tools and transported away from the vessel; and finally the mechanical seal had to be driven to a workshop, for instance by fork lift, where the mechanical seal housing could finally be opened and the worn parts of the mechanical seal removed. Thus there was at an early time the desire for simplification and acceleration of the process of exchanging the mechanical seals of stirring apparatuses, if possible performing the operation without disassembling the gear and while the vessel remained filled and the overpressure in the container, if any, was maintained. In order to be able to exchange the mechanical seals which surround the stirring shaft, a space had to be created at some point on the shaft, for instance by opening up split couplings, flange connections or the like, the space being as tall as the mechanical seal housing which was to be removed laterally through this space. In a corresponding manner, this space created after the loosening of the shaft connection and after a portion of the shaft was driven upward also permitted the installation of a new seal.

Because of the necessity first to maintain the tight vessel seal during the operation of changing seals and second to create an interruption in the course of the shaft in order to enable the removal of the seal which was to be changed, the entire structure of the apparatus, and in particular the embodiment of the drive means, which included a gear for stepping down the rpm of an electromotor, had to be considered along with the problems relating to simple exchangeability of the seals.

In stirring apparatuses where the electromotor drive with the associated gear is held at a distance from the vessel above the mechanical seal housing, this distance being established by means of a supporting stand (lantern), wherein at first the gear box was mounted onto the said suporting stand having a lateral window, the applicant first attempted to simplify the creation of the space in the course of the shaft, which was required for removal of the seals, by disposing the gear drive shaft in a bearing which was displaceable upward or outward and by providing this gear drive shaft with an outer thread which could be made to engage a stationary inner thread. This is described in German published application No. 1 782 266. This procedure enabled the axial adjustment of the gear drive shaft by means of the gear drive motor, without precluding the possibility of moving the shaft by hand if exceptional circumstances made this necessary. As a result, the necessity for removing the gear or the gear drive shaft in order to be able to exchange the mechanical seal was already eliminated.

A further proposal of applicant, disclosed in German laid open application No. 1 632 458, then took as its object, by means of one and the same threaded sleeve, which could be driven by a motor, first, lowering the stirring shaft in order to seal the vessel during the changing of the seals and, second, after separating the gear drive shaft from the stirring shaft by means of loosening the coupling connecting the two, driving the gear drive shaft upward, without severing its connection with the gear, so high that the space required for removal and insertion of the seals was created between the ends of the shafts.

The gear box, in both cases, was seated on the supporting housing, called a "lantern" and having a window for the purpose of lateral removal of the seal. The lower portion of the supporting housing also surrounded the actual separate housing for the seal, preferably a mechanical seal.

In order to further simplify the exchange of the mechanical seals in stirring apparatuses, but to save the effort of having to lift up a separate, heavy mechanical seal housing, and in order to embody the entire stirring apparatus in a more compact, space-saving manner, applicant then proposed using the lower portion of the gear housing as the seal housing and placing the unit thus created, in which there was no longer any room intended for exchanging seals or seal elements between the gear housing and the vessel, directly on the vessel, as is disclosed in German Pat. No. 1,750,468. A supporting housing (lantern) with a window intended for the lateral removal of, in this case, only the internal worn parts of the mechanical seal was now placed on the gear housing, but it was now used only for supporting and bearing threaded elements which enabled, in particular, the axial lifting of the gear drive shaft with the internal seal elements. The separation of the gear drive shaft, here embodied as a hollow shaft, from the stirring shaft was effected by removing a tension bolt which was threaded from the top through the hollow shaft and into a conical portion of the stirring shaft.

In order to simplify and accelerate the lateral removal of the seal through the lantern window, which represents one step of the seal exchanging process, and the reintroduction of a new seal by the same way, the seal housing in some cases being very heavy, the applicant further proposed pivotably supporting a carrier element, for bearing the old seal which was to be removed and for the new seal which was to be inserted, on the support stand (lantern) and disposing it so as to pivot about a vertical shaft and to be adjustable in its level on the shaft. This is disclosed in German published application No. 1 809 018.

Finally, for small stirring apparatuses and in particular for vessels which need not remain under pressure during the exchange of the seals and where no separate lifting apparatus is required for the mechanical seal, which in this case is smaller and lighter in weight, applicant developed a more slender and lighter-weight structure. Here, the seal housing itself was embodied as a load-bearing element and the connection point between the gear drive shaft, embodied as a hollow shaft, and the stirring shaft was located inside the unit enclosed by this load-bearing housing. The shaft connection itself was again effected by means of a tension bolt which could be loosened from the top, and the drive motor and the gear formed the top of the apparatus. These latter two elements rested, via two housing portions, on the seal housing embodied as a load-bearing element. The seal housing was intended to be usable in modular fashion in structures having various overall designs. This arrangement is disclosed in German published application No. 20 04 392.

In the structural types described above, the gear had always to be separately adapted to the overall structure; that is, it has to be a specialized gear. In like manner, the threaded elements used for generating axial lifting movements had to be specialized structural components. Both factors resulted in high manufacturing costs. This was also true of the structural type described in German Pat. No. 1,226,987. Here a closed box, called an intermediate housing, was flanged onto the vessel and enclosed the mechanical seal, disposed in a completely separate housing of its own, leaving open a relatively large distancing space. A driving electromotor was flanged onto this intermediate housing at the side. The distancing space was utilized for housing lifting spindles which engaged the base of a gear housing placed on top of the intermediate housing. As is generally known, spindles corrode easily and rapidly seize. A bearing body, here called a lantern, was placed on top of the gear housing and was intended for bearing the gear drive shaft, which extended upward and was embodied as a hollow shaft. The drive shaft was connected to the stirring shaft by means of a clamp connection which could be prestressed hydraulically and held in the stressed state by mechanical means. The housing of the mechanical seal was flanged onto the base of the gear housing. When the motor was uncoupled, the gear housing could be driven upward, together with the housing of the mechanical seal flanged to its base, with the aid of the lifting spindles after the clamp connection between the hollow shaft supported in the gear housing and the stirring shaft was loosened; the extent of this upward movement was such that the housing of the mechanical seal arrived, with the seal, at a point beyond the upper end of the stirring shaft. The patent specification said of the lifting spindles only that a plurality thereof was included in the apparatus and that they were enclosed, via chain gears, by a roller chain, not shown, and by a crank drive, for example, also not shown. It was not discussed whether the crank drive was supposed to be a manual drive means or whether a special motor was to be provided for the spindles; similarly, the guidance of the gear housing was not explained, where, with the mechanical seal housing flanged to its base, the gear housing was to be lifted upward by the spindles beyond the end of the stirring shaft and in the raised position then removed, along with its contents, between the spindles. It was stated in the specification only that "repair operations, such as exchanging the sealing elements" could be undertaken in the raised position. It was described as an advantage in this patent that as result of combining all the structural components needed for sealing, bearing and driving purposes in or on the gear, all the elements necessary from the standpoint of their technical function derived from one and the same delivering factory system and could be tested thereby before installation. In actuality, many different kinds of specialized elements had to be produced by one and the same factory, which is a grave disadvantage in economical terms and one which is associated to a greater or lesser extent with all structural types which have required the use of specialized gears. While on the one hand the structural types intended for rapid and simple exchanging of mechanical seals became increasingly expensive, on the other hand the service life of the mechanical seals became longer, so that it was necessary to perform rapid seal changes only relatively infrequently and in specialized applications. For normal uses, buyers accordingly began to make do without the expensive, rapid-changing apparatuses which they expressly requested for special uses, returning instead to the old, time-consuming procedure of removal of half the stirring apparatus in order to exchange the mechanical seals.

Moreover, many conventionally embodied stirring apparatuses have been in operation for years, which lack any features which simplify the dismantling of mechanical seals or stuffing-box seals. These stirring apparatuses thus present their users with the significant disadvantages noted above whenever the seals must be exchanged, especially the disadvantage of long periods of idleness.

OBJECT AND SUMMARY OF THE INVENTION

The object of the invention is accordingly the creation of an arrangement suitable for both the retroactive conversion of older stirring apparatuses and for newer stirring apparatuses as well, in which latter case a simpler overall design results, this arrangement being intended to simplify the exchange of seal elements subject to wear, especially mechanical elements. In the case of new stirring apparatuses rather than the modernization of old ones, the intention is to avoid the known features for simplifying the exchange of worn-old sealing elements and instead to replace them by simpler features. In particular, it is intended to enable the use of conventional standard gears which are available on the market in various types and at favorable prices from specialized manufacturers; examples of these are spur gears, bevel spur gears, worm gears, planetary gears, and control gears of every kind, equipped as a rule for the vertical flanging thereon of normal gear motors, such as rotary-current motors, and including the known hydrostatic and hydrodynamic drive units with infinitely variable rpm, which are offered on the market as complete units.

In accordance with the invention, this object is attained in that in a stirring apparatus of the general type described at the onset at least one portion of the lantern, which carries the drive elements, is embodied as being removable from the vessel by means of a hydraulic cylinder and able to be guided back onto it (in the case of a vertically disposed stirring shaft, the said portion of the lantern can be raised and lowered) and is embodied as needed for the coupled movement of the seal housings or seal elements occurring along with the motion just described. In this apparatus, the hydraulic cylinder or cylinders is or are efficiently firmly attached to an element (mounting flange) secured to the vessel, while the piston or pistons engage the element of the lantern which carries the drive elements.

The applicability of the embodiment according to the invention for the modernization of stirring apparatuses of the type which was conventional earlier is a result of the fact that one or two hydraulic cylinders can always be easily disposed either inside a lantern already present in the apparatus or, if this is not possible, then outside the lantern but adjacent thereto.

A further refinement of the invention is that guide bolts are disposed coaxially with the stirring shaft outside the hydraulic cylinder or cylinders between the portion attached to the housing (for instance, a mounting flange) and the portion of the lantern carrying the drive elements; in most of the known structural types, this will be a lantern which is a single, unitary structural element. Guides for such bolts can easily be attached in the portion of the lantern carrying the drive elements, which is moved by the hydraulic cylinders, when older stirring apparatus are to be modernized. For example, guide cams or flanges including guide bushings can be welded onto the apparatus.

The intended embodiment of new stirring apparatuses, in contrast to the modernization of older ones, and making use of the hydraulic lifting capacity of the element carrying the drive elements, is also intended, as already mentioned, to attain the partial object of the invention having to do with making it possible to dispense with specialized gears such as those previously used for the purposes of simplifying the exchange of seals. Thus it has been an object of the invention to eliminate the requirement, earlier described as advantageous, that one and the same manufacturer should produce not only the specialized gear but also the elements of a stirring apparatus which cooperate with it. Instead, it is intended to enable the use of normal gear units, obtainable on the open market, in the drive of the stirring apparatus, no matter where or how the remaining elements of the drive means were produced or how they were embodied in detail. The immediate result of this was that in attaining this object it was no longer possible to use the older method of disposing hollow shafts in the gear to enable the performance of stroke movements, since this method always requires a specialized gear embodiments. In order to be able to do without the specialized gear embodiment which enables mechanical lifting, use was made of the feature, known per se, of transferring the housing function performed by the mechanical seal housing—which then had to be lifted as well when the gear was lifted—to a stationary structural component which would perform a supporting function along with the mechanical seal housing; thus only the worn elements themselves need to be lifted when they are to be changed, and not their housings as well. While the total weight, as noted above, of a relatively large mechanical seal with its housing amounts to 400 kg, the weight of the worn parts of such a seal is only one-tenth as much, i.e., from 40 to 50 kg. The feature discussed above was already known in the sense that a housing portion replacing a separate mechanical seal housing was known to form the lower portion of the gear housing, as described in the German Pat. No. 1,750,468 noted above; the same feature was also known in the sense that the mechanical housing was utilized as a stationary, load-bearing housing for further so-called intermediate housing elements or lantern elements to be placed upon it, as is described in the German published application No. 20 04 392 which has also been noted above. The use of this feature, known per se, has produced a further embodiment of the invention, in that the lantern is subdivided into a first lantern portion fixed on the mounting flange (in the case of vertical disposition of the stirring shaft, this is the lower lantern portion) and a second lantern portion (the upper portion when the stirring shaft is disposed vertically) which also bears the stirring shaft drive including an associated gear and the stirring shaft bearing and is movable relative to the first portion, guided in the axial direction, by means of an auxiliary drive and further in that the sealing elements are disposed in the first portion, being movable out of it in the axial direction. The second lantern portion is also called a "lifting lantern".

The sealing elements here need not be a mechanical seal; instead, they may also be the elements of a stuffing box packing. If slit or split sealing rings are used for a stuffing box packing, the stirring shaft does not need to be whether such a separability is provided or not, in using stuffing box packings a further refinement of the invention is represented in that the stirring shaft has, below the stuffing box seal elements disposed in the lower lantern portion, a collar undercutting these elements, and further in that the second (upper) lantern portion, the "lifting lantern", has a centering collar which fits into the annular chamber in the first (lower) lantern portion, which chamber receives the stuffing box seal elements and is defined on the inside by the stirring shaft.

Previously it has often been very tedious to remove stuffing box packing rings which had become soiled, sticky or hard and to replace them with new rings. Because the lifting lantern provided in accordance with the invention also raises all the elements with it which are carried thereon when it is lifted by means of its own drive, these raised elements also including the undivided stirring shaft, in the last-mentioned further refinement of the invention the collar of the stirring shaft which undercuts the packing rings displaces the packing rings upward and out of the lower, stationary lantern portion which is embodied as a seal housing. Because specialized gears can be dispensed with, this advantage can be attained at low expense, suited to the lower cost of stuffing box packings. Inserting new sealing rings is simplified in that during the downward movement of the lifting lantern the sealing rings are pressed by means of the centering collar into the annular chamber receiving them and then compressed, so that a split stuffing box gland, which would otherwise be necessary, and the cost associated with it, can be dispensed with.

A further refinement of the invention, adapted to the usage of mechanical seals, which necessitate the disposition of a separable upper portion of the stirring shaft, provides that the unit comprising the mechanical sealing elements, held together by a lightweight cage, is secured on the centering collar of the lifting lantern. During operation, this unit is housed in the lower lantern portion, which is used as the stationary mechanical seal housing. Now if the mechanical seal is to be changed, then upon raising the lifting lantern at the centering flange of the lifting lantern by means of its auxiliary drive the unit secured thereon, comprising the inner mechanical sealing elements, is also lifted; the separated, lower portion of the stirring shaft meanwhile remains in its original position. Because the upper, separated shaft portion is lifted together with the lifting lantern, a space is created between the two shaft portions, into which the mechanical seal unit, raised along with the lifting lantern, finally enters. Thus the elements of the mechanical seal unit can then be removed downwards and replaced by new elements, with the elements then being guided back together again by the subsequent downward movement of the lifting lantern. The auxiliary drive of the lifting lantern should thus be efficiently embodied such that upward and downward movement occurs under power.

The basic concept, that is, to design the stirring apparatus so as to use as few specialized units as possible (which would otherwise require a corresponding specialized embodiment of the elements adjacent to them as well) and instead to enable the use as much as possible of structural units normally obtainable on the market, is applied here as well to the auxiliary drive means, because hydraulic cylinders are provided as the auxiliary drive means. Two hydraulic cylinders acting in opposing directions can be used; however, it is most efficient to use at least one double-acting or bi-directional hydraulic cylinder. The hydraulic cylinder enables a close approach to the stirring shaft, whose geometric axis represents the geometric primary central axis of the entire stirring apparatus. Thus, bending and tilting moments can be kept small. Impermissible bending and tilting stresses are also precluded by assigning the hydraulic cylinder at least one guide bolt for the lifting lantern, the bolt being located opposite the hydraulic cylinder and axially parallel to the stirring shaft. If the upper flange of the lower, stationary lantern portion is substantially triangular in plan view (having the form, for instance, of an equilateral triangle), then for the sake of attaining the stablest possible embodiment despite the slender overall design a bi-directional hydraulic cylinder is efficiently attached to one corner of this triangle; in the other two corners, guide bolts are disposed which in this case may have a somewhat smaller diameter than if only one guide bolt, diametrically opposite the hydraulic cylinder, were provided. In the arrangement with two guide bolts as well, a great deal of free space remains on all sides between the guide bolts and the hydraulic cylinder, so that the inner parts of the mechanical seal, which have of course been raised without their housing, and from the weight of which they have accordingly been released, can be easily removed at the side without requiring specialized auxiliary devices. The insertion of the new mechanical seal elements is correspondingly convenient.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
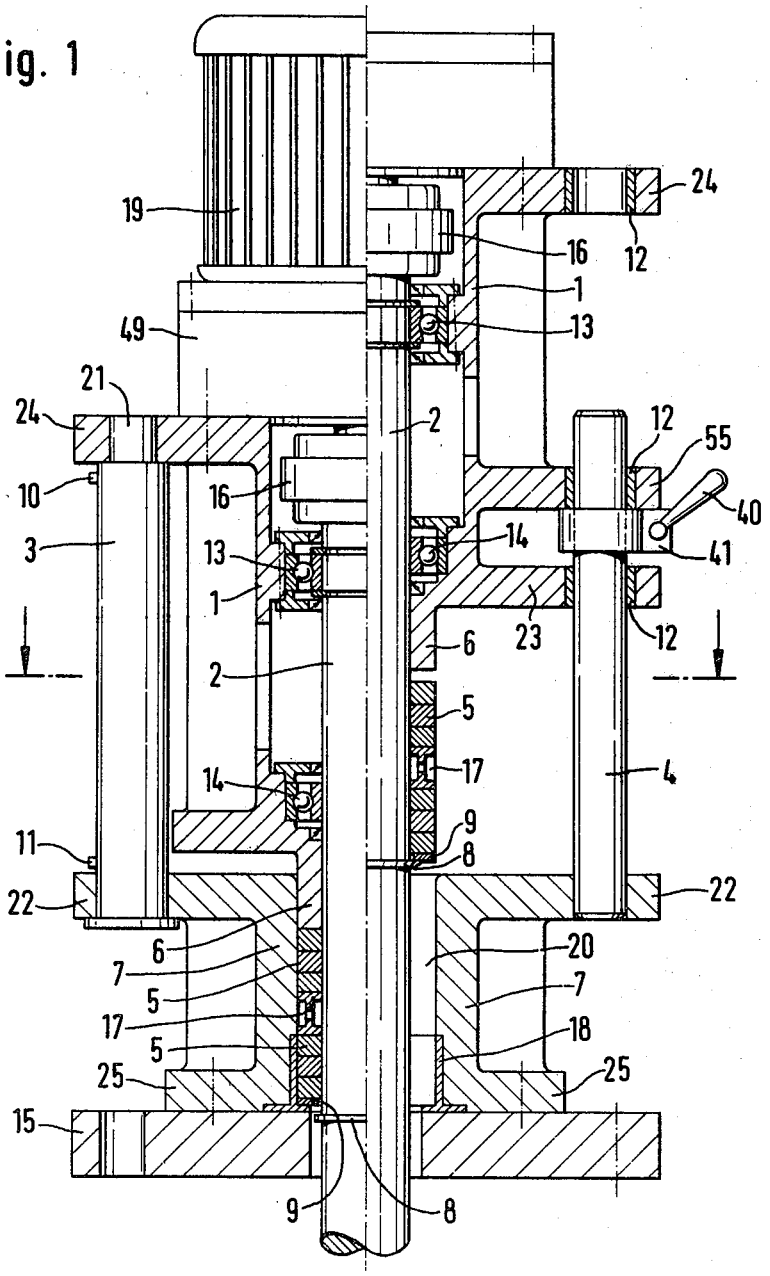
FIG. 1 is a lengthwise section taken through a first embodiment having stuffing box packing for the stirring shaft, with the left-hand portion of the drawing showing the elements in the operational position, and the right-hand portion showing them in the position they assume when they have been lifted upward or outward.
Figure 2:
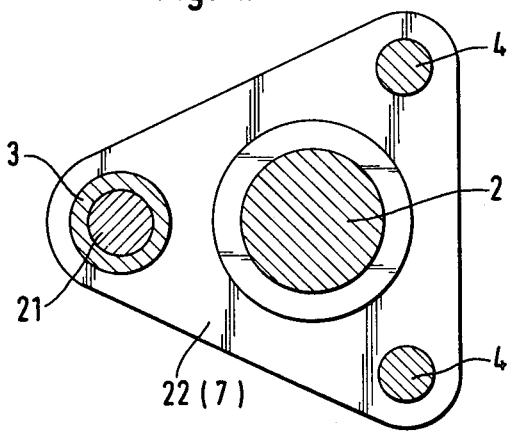
FIG. 2 is a section along the horizontal sectional plane indicated in FIG. 1 by broken lines, showing two guide bolts.
Figure 3:
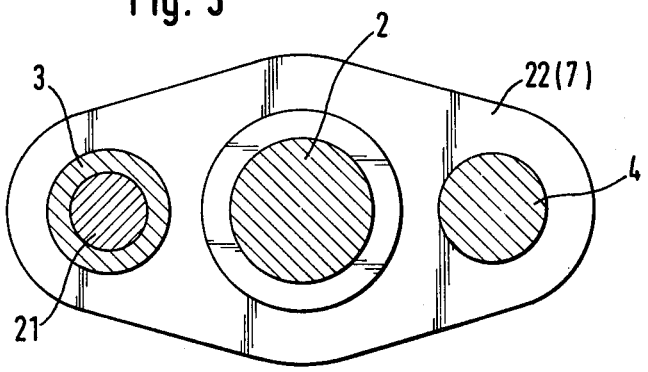
FIG. 3 is a variant of the embodiment shown in FIG. 2, in a corresponding horizontal section, where only one guide bolt is provided.

In the exemplary embodiment shown in FIGS. 1–3, a lower lantern portion 7 is secured by means of a flange 25 on an attachment flange 15, which is intended to be placed tightly over the opening of a pressure vessel. An upper lantern portion, the "lifting lantern" 1, protrudes into the lower lantern portion 7 in an axially displaceable manner via a centering collar 6. An upper flange 24 of the upper lantern portion 1 carries a driving electromotor 19 and an arbitrarily embodied gear 49 which are intended to drive a stirring shaft 2 via an elastic coupling 16. The stirring shaft 2 is supported at its rearward end in the upper lantern portion 1 in a fixed bearing 13 and, at a distance apart therefrom, in a movable bearing 14. When the upper lantern portion 1 is raised and lowered relative to the lower lantern portion 7, the stirring shaft 2 is carried along with it via the fixed bearing 13.

An annular chamber 20 is formed in the lower lantern portion 7, between the latter's cylindrical, hollow chamber which receives the collar 6 of the upper lantern portion 1 and the stirring shaft 2, and this annular chamber 20 houses packing rings 5. Two layers of such packing rings are provided, with a lubricating ring 17 disposed between them. The packing rings 5 rest on a stationary mounting ring 9, which is undercut by a collar 8 disposed on the stirring shaft 2. The lower packing rings and the stationary mounting ring 9 are received by a bushing 18, which lines the lower portion of the lower lantern portion 7 in order to protect it from chemically reacting with the contents of the vessel. The bushing 18 may be made of metal or of ceramic materials, or it may be rubber-coated.

A hydraulic cylinder 3 is secured in the upper flange 22 of the lower lantern portion 7, the piston 21 of which cylinder engages the upper flange 24 of the upper lantern portion 1. In the illustrated example, a bi-directional hydraulic cylinder is assumed, having screw connections 10 and 11 for the attachment of oil pressure hoses. The cylinder can be driven by means of a hydraulic hand pump, such as are generally used in workshops for removing or replacing roller bearings, for instance.

Guide bolts 4 are likewise secured in the upper flange 22 of the lower lantern portion 7. These guide bolts pass through guide sleeves 12 which are provided in the lower flange 23 and the upper flange 24 of the upper lantern portion 1.

When the piston 21 of the hydraulic lifting cylinder 3 is pushed out of the cylinder, the upper lantern portion 1 in FIG. 1 is lifted with its lower collar 6 out of the lower lantern portion 7, by which means the collar 8 of the stirring shaft 2, which is also raised at this time via its fixed bearing 13, pushes the packing rings 5 and the lubricating ring 17, via the stationary mounting ring 9, upward out of the annular chamber 20 until the elements are in the position shown in the right-hand portion of FIG. 1. In this position, they are freely accessible between the lifting cylinder 3 and the guide bolt 4. The renewed elements can then be put back into the annular chamber 20 by means of the collar 6, until they once more assume the position shown in the left-hand portion of FIG. 1.

The packing rings 5 are subject to wear resulting from the effects of temperature and, depending on the contents of the vessel which are to be stirred, from chemical influences as well, so they must frequently be retightened or renewed. They may even become charred, so that the fact that these elements are automatically pushed out of the annular chamber (which otherwise receives them) until they are freely accessible represents a substantial simplification.

As FIG. 1 shows, the diameter of the attachment flange 15 may be small in proportion to the height of the stirring apparatus; on the other hand, this diameter can be selected as desired to suit the pressure vessel onto which the stirring apparatus is to be placed. Without changing anything relating to the manner of removing the sealing elements, the drive of the stirring shaft 2 which is carried by the flange 24 of the upper lantern portion 1 can also be embodied in many ways.

The lifting lantern 1 is efficiently secured against both unintended raising out of its lowered position (which could undesirably interrupt the operational status of the seal) and unintended lowering out of its raised position. Because hydraulic cylinders are used as an auxiliary drive for the lifting lantern, this securing can be effected via an electrical monitoring of the control valves of the hydraulic cylinder. However, it has proved to be particularly simple and reliable to provide mechanical securing in the form of a clamp ring 41, which can be attached between the flanges 23 and 55 of the lifting lantern 1 on the guide bolt 4. In both its raised and lowered position, the lifting lantern 1 can be mechanically secured very simply, as shown in FIG. 1, in that the clamp ring 41 is displaced upward or downward in the axial direction against the surface of the flange 23 or 55 and tightened by means of a toggle 40.

Figure 4:
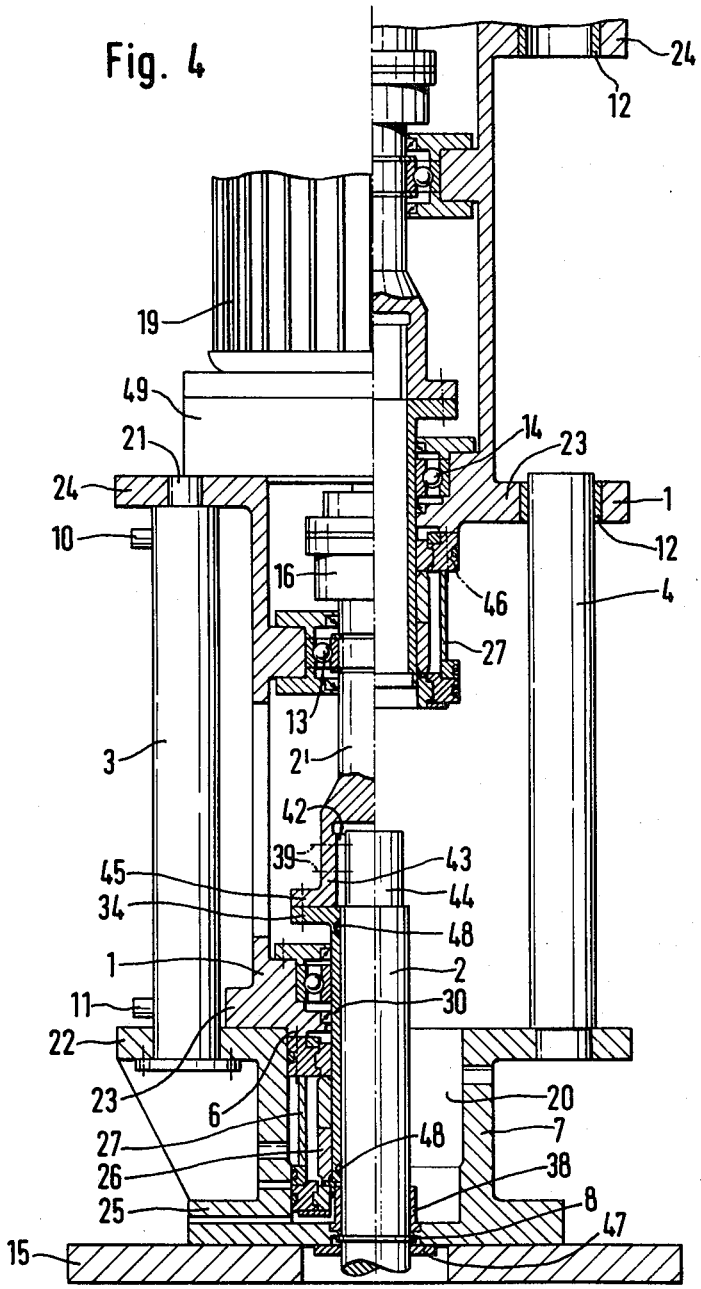
FIG. 4 is a lengthwise section taken through a second embodiment having a mechanical seal, with the left-hand portion of the drawing, as in FIG. 1, showing the operational position and the right-hand portion showing the raised position.

As in the exemplary embodiment of FIGS. 1–3, a lower lantern portion 7 is also secured in the embodiment of FIG. 4 by means of a flange 25 to an attachment flange 15 which is to be placed tightly over the opening of a pressure vessel. A centering collar 6 of an upper, movable lantern portion (namely the lifting lantern) 1 protrudes into the lower lantern portion 7 to engage it. The lifting lantern 1 has a lower flange 23 and an upper flange 24. The upper flange 24 carries a driving electromotor 19, which drives the stirring shaft 2 via a gear 49 and an elastic coupling 16. The stirring shaft 2 of the example of FIGS. 1–3 is subdivided here, in the example of FIG. 4. Its upper portion 2', adjacent to the driven side of the coupling 16, is supported in the fixed bearing 13, which in turn is held in the lifting lantern 1; thus this upper shaft portion 2' travels upward whenever the lifting lantern 1 is raised. The upper shaft portion 2' is not flanged directly onto the stirring shaft 2 but rather via a flanged casing 30 surrounding the stirring shaft 2. On the upper end of casing 30 a flange 34 is located. On its lower end, the upper shaft portion 2' has a bell-shaped, widened attachment 43, into which a stepped end stud 44 of the stirring shaft 2 is inserted, with an interposed feather key 42. The drive torque is transmitted via this feather key 42 from the upper shaft portion 2' onto the stirring shaft 2. On account of the connection of the flange 34 of the flanged casing 30 with the flange 45 of the upper shaft portion 2', the flanged casing 30 is also rotated along with the stirring shaft 2 during operation, without any relative motion occuring between the stirring shaft 2 and the flanged casing 30. The upper shaft portion 2' and the stirring shaft 2 are secured against axial displacement relative to one another by press screws 39, which exert pressure on the feather key 42 and thus on the end stud 44 of the stirring shaft 2.

A cage 27 is screwed to the centering collar 6 of the lifting lantern 1 with screws 46 and combines the mechanical sealing elements into a unit 26. The mechanical sealing elements are seated on the flanged casing 30. During operation, the cylindrical annular chamber 20 formed in the lower, stationary lantern portion 7 receives the cage 27 with the mechanical seal unit 26. Thus, the lower, stationary lantern portion 7 is at the same time the mechanical seal housing. A pipe section 38 is shrink-fitted into the lower flange 25 of the lower lantern portion 7 concentrically with the geometric axis of the stirring shaft 2. In this manner, a labyrinth seal is effected, which prevents the passage therethrough of leaking material.

As in the exemplary embodiment shown in FIGS. 1–3, a hydraulic cylinder 3 is secured in the upper flange 22 of the lower, stationary lantern portion 7, the piston 21 of which engages the upper flange 24 of the lifting lantern 1. In the illustrated example, a double acting hydraulic cylinder is again assumed, having line connection couplings 10 and 11, embodied as screw connections, for example, for the attachment of oil pressure hoses.

Again as in the first exemplary embodiment, the embodiment of FIG. 4 also has guide bolts 4 secured in the upper flange 22 of the lower, stationary lantern portion 7, these bolts 4 passing through the guide sleeves 12 attached to the lower flange 23 and the upper flange 24 of the lifting lantern 1.

When the mechanical seal is to be changed, the means for securing against relative axial movement, which is created between the end stud 44 of the stirring shaft 2 and the bell-shaped, widened attachment 43 of the upper shaft portion 2' and is embodied here by screws 39, is first rendered ineffective, so that the stirring shaft 2, with its collar 8, can drop of its own weight onto a sealing ring 47 inserted in the attachment flange 15, thus continuing to provide sealing for the interior of the vessel.

After this has been done, the lifting lantern 1 can be driven upward by means of the hydraulic cylinder 3; during this operation, the connection between the flanges 34 and 45 does not need to be broken. When the lifting lantern 1 is raised, the cage 27 of the mechanical seal 26 screwed to the centering collar 6 is carried along with it, as is the flanged casing 30, until the elements have arrived in the position shown in the right-hand portion of FIG. 4. When the screws 46 are loosened in this position, the old mechanical seal elements can easily be removed downward and replaced by new elements inserted upward.

Sealing rings 48 are disposed in the inner jacket of the flanged casing 30 which seal off the flanged casing 30 from the stirring shaft 2 in the operational position.

In this exemplary embodiment as well, the lifting lantern 1 is efficiently secured mechanically by means of a toggle 40 and a clamp ring 41 in either the lowered or the raised position, in the manner already described in connection with FIGS. 1–3. The hydraulic cylinder then does not necessarily need to remain under pressure for the time required to change the seals.

Figure 5:
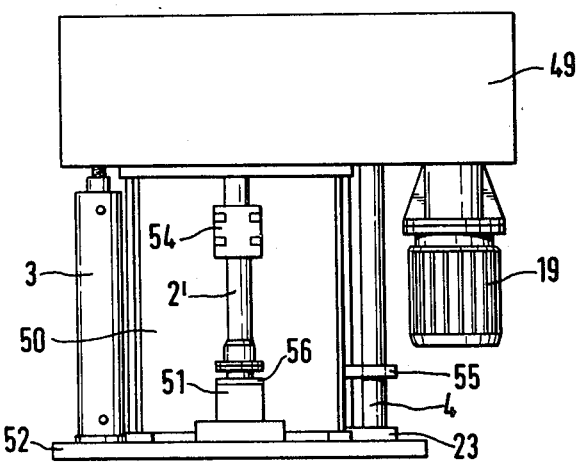
FIG. 5 shows in its operational position a conventional stirring apparatus, which has been modernized according to the invention by the retroactive installation of lifting hydraulics in order to accelerate the changing of the seals.
Figure 6:
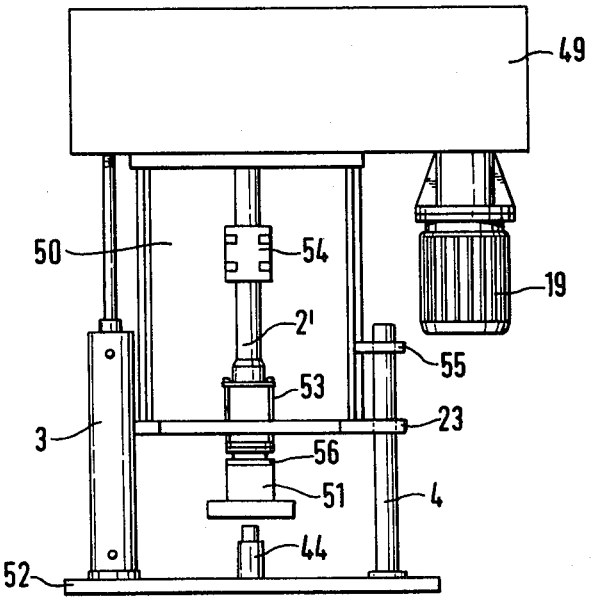
FIG. 6 shows the same stirring apparatus after the lantern carrying the drive elements has been lifted.

In the exemplary embodiment shown in FIGS. 5 and 6, the hydraulic cylinders 3 and the guide bolts 4 are retroactively installed on a stirring apparatus of known structural type, on which the lantern 50 carries a gear 49, onto whose housing a motor 19 is flanged from the bottom. The hydraulic cylinders are secured on a mounting flange 52. The gear drive shaft and the upper portion 2' of the stirring shaft are releasably connected with one another by means of a rigid coupling 54. The housing of a conventionally available mechanical seal 51 bears an upper flange 56. The lifting pistons of the hydraulic cylinders 3 here engage the base of the housing of the gear 49; however, if they cannot be housed inside the lantern 50, they can instead also engage it by means of cantilever arms rigidly connected to the lantern 50. The guide bolts 4, also secured on the mounting flange 52, are guided in flanges 23 and 55 of the lantern 50; the flange 55 contains a guide sleeve for the bolt 4.

After the lantern 50 has been released from elements fixed on the vessel, it is driven upward into the position shown in FIG. 6, without releasing the rigid coupling 54 with the upper shaft portion 2', which represents an intermediate part, by means of the hydraulic cylinder 3. The housing of the mechanical seal 51 was previously connected with the shaft portion 2' by means of its flange 56, such as is provided on many conventionally available mechanical seals, and a removal aid 53 containing rigid connection elements. Therefore when the lantern is raised the mechanical seal housing is pulled up, away from the shaft stub 44. In the raised position, it is easily possible to remove and replace the mechanical seal or its worn elements, in the manner described in connection with FIG. 4.

In the exemplary embodiments of FIGS. 1–3 and 4, the arbitrarily embodied gear 49 may, in exceptional cases, be omitted entirely; then the motor 19 drives the stirring shaft 2 directly via the elastic coupling 16. The entire apparatus can then be embodied as particularly slender, without being further interrupted in its upper portion by a gear housing protruding beyond the circumference of the motor housing.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A stirring apparatus arranged to be sealingly mounted to a container filled with material to be stirred, comprising:

a mounting flange arranged to be placed tightly around the container;

drive means;

an axially extending stirring shaft arranged to extend through said mounting flange into the container for supporting a stirring tool at one end which extends into the container and driven at its other end located outwardly from the container and remote with the mounting flange by said drive means;

sealing means enclosing said stirring shaft and disposed on the side of the mounting flange arranged to face outwardly from the container for sealing the stirring shaft from the contents of the container;

a load bearing intermediate housing laterally encircling said stirring shaft and extending between said mounting flange and said drive means, said housing having an axially extending annular chamber adjacent said mounting flange for receiving said sealing means in closely fitting contact, said load bearing intermediate housing having at least one portion extending in the axial direction of said stirring shaft spaced from said mounting flange and supporting said drive means, said portion includes means for axially guiding said portion and said means includes at least one hydraulic cylinder for guidingly displacing said portion along with at least the part of said stirring shaft laterally encircled by said portion and said sealing means toward and away from said mounting flange for affording access for the replacement of said sealing means.

2. The stirring apparatus as defined in claim 1, wherein said at least one hydraulic cylinder is a double-acting hydraulic cylinder.

3. The stirring apparatus as defined in claim 1, further comprising:

at least one guide bolt disposed between said mounting flange and said drive means extending parallel to said stirring shaft and extending through said intermediate housing including said at least one portion thereof for guiding the displacement of said at least one portion.

4. The stirring apparatus as defined in claim 3, further comprising:

a guide sleeve for each said guide bolt, said guide sleeve being mounted to said at least one portion of the intermediate housing.

5. The stirring apparatus as defined in claim 1, wherein said intermediate housing has an upper portion which comprises said guidingly axially displaceable portion and a lower portion including said annular chamber into which a part of said upper portion extends, a part of said stirring shaft and said sealing means are received in and are movable into and out of said lower portion, the part of said stirring shaft and said sealing means are guidingly axially displaceable, and wherein said drive means includes a gear and stirring shaft bearings.

6. The stirring apparatus as defined in claim 5, wherein said sealing means comprise a stuffing box packing and a collar is supported by and on the stirring shaft below said stuffing box and remains in place when the stuffing box packing is moved in an axial direction away from said mounting flange.

7. The stirring apparatus as defined in claim 5, wherein the lower portion defines an annular chamber into the part of the upper portion extends, the part of the stirring shaft and the sealing means are received in and are movable into and out of said lower portion, the part of the stirring shaft and the sealing means are axially movable, wherein the inner surface of the annular chamber is defined by the stirring shaft, and wherein the upper portion includes a centering collar and fits into said annular chamber.

8. The stirring apparatus as defined in claim 5, wherein the upper portion includes a centering collar, wherein said part of said stirring shaft includes a separable upper shaft portion, said sealing means comprises a slide ring seal unit having sealing elements held together by a lightweight cage, said unit being secured to the centering collar, and wherein the centering collar is housed in said lower portion during operation.

9. The stirring apparatus as defined in claim 5, wherein the lower portion is mounted to the mounting flange, and wherein said drive means further includes an elastic coupling and an electromotor which drives the stirring shaft through the elastic coupling.

10. The stirring apparatus as defined in claim 9, further comprising:

a collar, wherein said sealing means comprise a stuffing box packing, and wherein the collar is carried by the stirring shaft and undercuts the stuffing box packing.

11. The stirring apparatus as defined in claim 1, further comprising:

a safety device for securing said axially displaceable upper portion in a given position.

12. The stirring apparatus as defined in claim 1, wherein the stirring shaft and sealing means are adapted for displacement with said guidingly axially displaceable portion.

13. The stirring apparatus as defined in claim 1, wherein the hydraulic cylinder includes a piston engageable with said guidingly axially displaceable portion.

* * * * *